US007665507B2

(12) United States Patent
Naoki

(10) Patent No.: US 7,665,507 B2
(45) Date of Patent: Feb. 23, 2010

(54) BLIND

(75) Inventor: Takebayashi Naoki, Tokyo (JP)

(73) Assignee: Nichibei Co., Ltd, Tokyo (JP)

( * ) Notice: Subject to any disclaimer, the term of this patent is extended or adjusted under 35 U.S.C. 154(b) by 553 days.

(21) Appl. No.: 11/355,416

(22) Filed: Feb. 16, 2006

(65) Prior Publication Data

US 2006/0191650 A1 Aug. 31, 2006

(30) Foreign Application Priority Data

Feb. 28, 2005 (JP) ..... 2005-054364

(51) Int. Cl.
*E06B 9/56* (2006.01)

(52) U.S. Cl. ..... 160/308; 160/170; 160/319

(58) Field of Classification Search ..... 160/297, 160/300, 301, 304.1, 307, 308, 319, 170; 192/223.2, 223.3, 223.4, 41 S
See application file for complete search history.

(56) References Cited

U.S. PATENT DOCUMENTS

| | | | | | |
|---|---|---|---|---|---|
| 1,797,204 | A | * | 3/1931 | Hadden | 160/298 |
| 2,012,261 | A | * | 8/1935 | Drumm | 160/303 |
| 4,466,475 | A | * | 8/1984 | Saito et al. | 160/297 |
| 4,476,910 | A | * | 10/1984 | Saito | 160/291 |
| 4,492,261 | A | * | 1/1985 | Chong | 160/319 |
| 4,662,423 | A | * | 5/1987 | Ishii | 160/293.1 |
| 4,838,333 | A | * | 6/1989 | Mottura | 160/305 |
| 5,099,906 | A | * | 3/1992 | Chigusa et al. | 160/297 |
| 5,167,269 | A | * | 12/1992 | Abo | 160/305 |
| 5,566,741 | A | * | 10/1996 | Ogawara et al. | 160/297 |
| 5,791,393 | A | * | 8/1998 | Judkins | 160/321 |
| 5,890,529 | A | * | 4/1999 | Haarer | 160/319 |
| 6,129,131 | A | * | 10/2000 | Colson | 160/84.02 |
| 6,131,642 | A | * | 10/2000 | Welfonder | 160/301 |
| 6,142,211 | A | * | 11/2000 | Judkins | 160/308 |
| 6,158,563 | A | * | 12/2000 | Welfonder et al. | 192/223.3 |
| 6,529,323 | B2 | * | 3/2003 | Okumura | 359/461 |
| 7,128,126 | B2 | * | 10/2006 | Smith et al. | 160/319 |

FOREIGN PATENT DOCUMENTS

| | | |
|---|---|---|
| JP | 59-195985 | 11/1984 |
| JP | 63-46224 B | 9/1988 |
| JP | 03-228992 | 10/1991 |
| JP | 07-082969 | 3/1995 |
| JP | 2001-027083 | 1/2001 |
| JP | 2002-138778 | 5/2002 |

* cited by examiner

*Primary Examiner*—David Purol
(74) *Attorney, Agent, or Firm*—Miller, Matthias & Hull

(57) ABSTRACT

A blind comprises a turnably supported pulley, a control member of which one end is connected to the pulley so as to permit the control member to be wound around and unwound from the pulley, an urging member which urges the pulley in the direction of winding the control member, a first clutch mechanism which is disposed between the rotation shaft and the pulley, and can selectively link the pulley and the rotation shaft with each other to transmit the rotation of the pulley to the rotation shaft or unlink the pulley and the rotation shaft from each other to interrupt the transmission of the rotation of the pulley to the rotation shaft, and a second clutch mechanism which can selectively link the rotation shaft and a fixed member with each other or unlink them from each other.

21 Claims, 13 Drawing Sheets

BLIND

BACKGROUND OF THE INVENTION

1. Field of the Invention

The present invention relates to a blind in which shielding member is raised or lowered according to the turning direction of a rotatably supported rotation shaft.

2. Description of the Related Art

A blind is usually configured such that a shielding member is rolled up or down or shielding member is raised or lowered by winding up or down lifting cords fitted to the lower end of the shielding member in response to an operation of a control member transmitting its controlling force to a rotatably supported rotation shaft. In these cases, the rotation shaft can either directly roll or unroll the shielding member or indirectly raise or lower the shielding member by winding up or down the lifting cord.

In order to ensure a sufficient operation length of the control member, which corresponds to the raising or lowering length of the shielding member, the control member is often configured in an endless form of a reasonable length, and usually hung down from a blind supporting member disposed at the top of the blind. This configuration often confuses the user as to which direction the user should operate the control member. Furthermore, part of the control member hung from the blind supporting member may catch a passer-by, a pet animal, furniture or the like, also may involve another problem of aesthetically poor appearance.

Japanese Examined Patent publication No. 63-46224 discloses a sheet rolling-up/down device in which the control member is compactly disposed, however none has yet been made available for practicable use.

In viewing the foregoing, an object of the present invention is to provide a blind which involves no fear of operating the control member in a wrong direction and can keep the control member compact when it is not operated.

SUMMARY OF THE INVENTION

In order to achieve the object stated above, according to a first aspect of the invention, a blind in which a shielding member is raised and lowered according to the turning direction of a turnably supported rotation shaft, comprises a turnably supported pulley, a control member of which one end is connected to the pulley so as to permit the control member to be wound around and unwound from the pulley, an urging member which urges the pulley in the direction of winding the control member, a first clutch mechanism which is disposed between the rotation shaft and the pulley, and can selectively link the pulley and the rotation shaft with each other to transmit the rotation of the pulley to the rotation shaft or unlink the pulley and the rotation shaft from each other to interrupt the transmission of the rotation of the pulley to the rotation shaft, and a second clutch mechanism which can selectively link the rotation shaft and a fixed member with each other or unlink them from each other.

The rotation of the pulley caused by an operation of the control member enables the rotation shaft via the first clutch mechanism to rotate in one direction. The rotation of the pulley by a prescribed angle caused by an operation of the control member causes the second clutch mechanism to unlink the rotation shaft and the fixed member from each other and enables the rotation shaft to rotate in the other direction. The rotation shaft can be stopped by the action of a first clutch mechanism or a second clutch mechanism in response to the rotation of the pulley caused by an operation of the control member while the rotation shaft is rotating in the other direction.

According to the invention, since the control member is wound up the pulley by the urging force of the urging member when the control member is not being operated, the control member can be kept compact and prevented from catching a passer-by, a pet animal or furniture.

When a user operates the control member to rotate the pulley, the rotation of the pulley is transmitted to rotate the rotation shaft in one direction so that the shielding member be raised or lowered in accordance with the rotating direction of the rotation shaft. The user can also unlink the rotation shaft and the fixed member from each other by operating the control member to turn the pulley to a prescribed extent and thereby cause the rotation shaft to rotate in the other direction so that the shielding member is raised or lowered in accordance with the rotating direction of the rotation shaft. The user can also stop the rotation shaft by operating the control member while the rotation shaft is rotating in the other direction, to turn the pulley. As the operation of the control member is always limited to the direction of unwinding the control member from the pulley, there is no possibility for the user to be confused about the operating direction, and accordingly the user can accomplish the operation easily and quickly.

According to a second aspect of the invention, a blind in which a shielding member is raised and lowered according to the turning direction of a turnably supported rotation shaft, comprises a turnably supported pulley, a control member of which one end is connected to the pulley so as to permit the control member to be wound around and unwound from the pulley, an urging member which urges the pulley in the direction of winding the control member, a rotator which is disposed between the rotation shaft and the pulley and rotates together with the pulley when engaging the pulley, a first clutch mechanism which is disposed between the rotation shaft and the rotator, and can selectively link the pulley and the rotation shaft with each other to transmit the rotation of the pulley to the rotation shaft or unlink the pulley and the rotation shaft from each other to interrupt the transmission of the rotation of the pulley to the rotation shaft, and a second clutch mechanism which can selectively link the rotation shaft and a fixed member with each other or unlink them from each other.

The rotation of the pulley caused by an operation of the control member enables the rotation shaft via the rotator and the first clutch mechanism to rotate in one direction. The rotation of the pulley by a prescribed angle caused by an operation of the control member causes the second clutch mechanism to unlink the rotation shaft and the fixed member from each other and enables the rotation shaft to rotate in the other direction.

Since the first clutch mechanism and the pulley are not directly coupled with each other but the rotator intervenes between the first clutch mechanism and the pulley, even if the first clutch mechanism is inclined due to the shielding member's own weight or like, the inclination can be prevented from being directly transmitted to the pulley, resulting in preventing the faulty operation of the urging member which urges the pulley.

In the blind according to the second aspect of the invention, a plurality of engaging stubs which are arranged in the circumferential direction can be formed on the rotator and a plurality of engaging stubs which are arranged in the circumferential direction and are to be engaged with said engaging stubs of the rotator can be formed on the pulley, and clearances of prescribed extents can exist between these engaging stubs. The clearances of the engaging stubs can absorb any inclination that may occur in the first clutch mechanism and thereby prevent the inclination from being transmitted to the pulley.

The pulley may be turnably supported by a fixed shaft, and the fixed member can include a supporting shaft which is unturnable relative to the fixed shaft. Even if the supporting shaft constituting the fixed member is bent by the shielding member's own weight or like, since the fixed shaft supporting the pulley is a separate part from the supporting shaft, the bend can be prevented from being transmitted to the pulley and the urging member which urges the pulley can be prevented from faulty operation.

When the rotation of the rotation shaft is stopped after the rotation shaft is rotated in one direction by the rotation of the pulley caused by an operation of the control member and transmitted to the ration shaft via the first clutch mechanism, the second clutch mechanism can operate to link the rotation shaft and the fixed member with each other to keep the rotations haft at halt. Additionally, when the pulley is turned by an operation of the control member while the rotation shaft is rotating in the other direction, the first clutch mechanism can operate to stop the rotation shaft. Since the rotational angle of the rotation shaft required for the linking/unlinking switch-over of the first clutch mechanism can be smaller than the rotational angle of the rotation shaft required for the linking/unlinking switch-over of the second clutch mechanism, the rotation shaft can be stopped quickly by the action of the first clutch mechanism, and the shielding member can be stopped in a desired position.

The control member can include a stopper for restricting the length wound up by the pulley. Restricting the extent of the winding of the control member around the pulley prevents the control member from being wound up by the pulley so far as to go beyond the reach of the user. The suspending length of the control member from the pulley can be set to an appropriate extent by the stopper. The stopper can also cause the first clutch mechanism to so act as to stop the rotation shaft.

The first clutch mechanism can comprise a switch-over guide which can turn relative to the pulley within a prescribed range of rotational angles and an engaging member which turns together with the switch-over guide and can selectively move to a position where it transmits the rotation of the pulley to the rotation shaft or to a position where it does not transmit the rotation of the pulley to the rotation shaft according to the relative turning angle between the switch-over guide and the pulley, and the switch-over guide is held by the fixed member with a force stronger than the rotational force received from the rotation shaft and weaker than the urging force received from the urging member. With this feature, it is possible to prevent, when the rotation shaft is rotating and the pulley is not, the switch-over guide from turning together with the rotation shaft and thereby causing the first clutch mechanism to perform inadvertent switching-over to invite faulty operation.

Alternatively, the first clutch mechanism can comprise a switch-over guide which can turn relative to the pulley within a prescribed range of rotational angles and an engaging member which turns together with the switch-over guide and can selectively move to a position where it transmits the rotation of the pulley to the rotation shaft or to a position where it does not transmit the rotation of the pulley to the rotation shaft according to the relative turning angle between the switch-over guide and the pulley, and the switch-over guide is forbidden from turning when the rotation shaft is rotating in the other direction and turns together with the pulley when the pulley is turned by the urging member in the direction of winding up the control member. With this feature, it is possible to prevent, when the rotation shaft is rotating and the pulley is not, the switch-over guide from turning together with the rotation shaft to turn and thereby causing the first clutch mechanism to perform inadvertent switching-over to invite faulty operation.

The rotation of the rotation shaft in the other direction can correspond to the direction in which the shielding member descends by its own weight. When the rotations haft is rotating in the other direction, the shielding member can be allowed to descend by its own weight.

The blind can further comprise a spring for urging the rotation shaft to turn in a direction corresponding to the ascending direction of the shielding member, wherein the rotation of the rotation shaft in the other direction corresponds to the direction in which the shielding member is raised by the spring. When the rotation shaft is rotating in the other direction, the shielding member can be allowed to be raised by the spring.

The rotation shaft can be a rolling-up pipe to which one end of the shielding member is connected so as to permit the shielding member to be wound around and unwound from the rolling-up pipe. Thus, the blind according to the invention can be applied to roll screens.

The rotation shaft can be a drum to which one end of a lifting cord, of which the other end is connected to the bottom of the shielding member, is connected so as to permit the lifting cord to be wound around and unwound from the drum. Alternatively, the rotation shaft can be a member unturnably connected to a drum to which one end of a lifting cord, of which the other end is connected to the bottom of the shielding member, is connected so as to permit the lifting cord to be wound around and unwound from the drum.

The blind according to the invention can be applied to horizontal blinds, pleated screens, Roman shades or the like.

The present disclosure relates to subject manner contained in Japanese Patent Application No. 2005-54364, filed on Feb. 28, 2005, which is expressly incorporated herein by reference in its entirety.

DETAILED DESCRIPTION OF THE PREFERRED EMBODIMENTS

Preferred embodiments of the present invention will be described below with reference to the accompanying drawings.

First Embodiment

Figure 1:
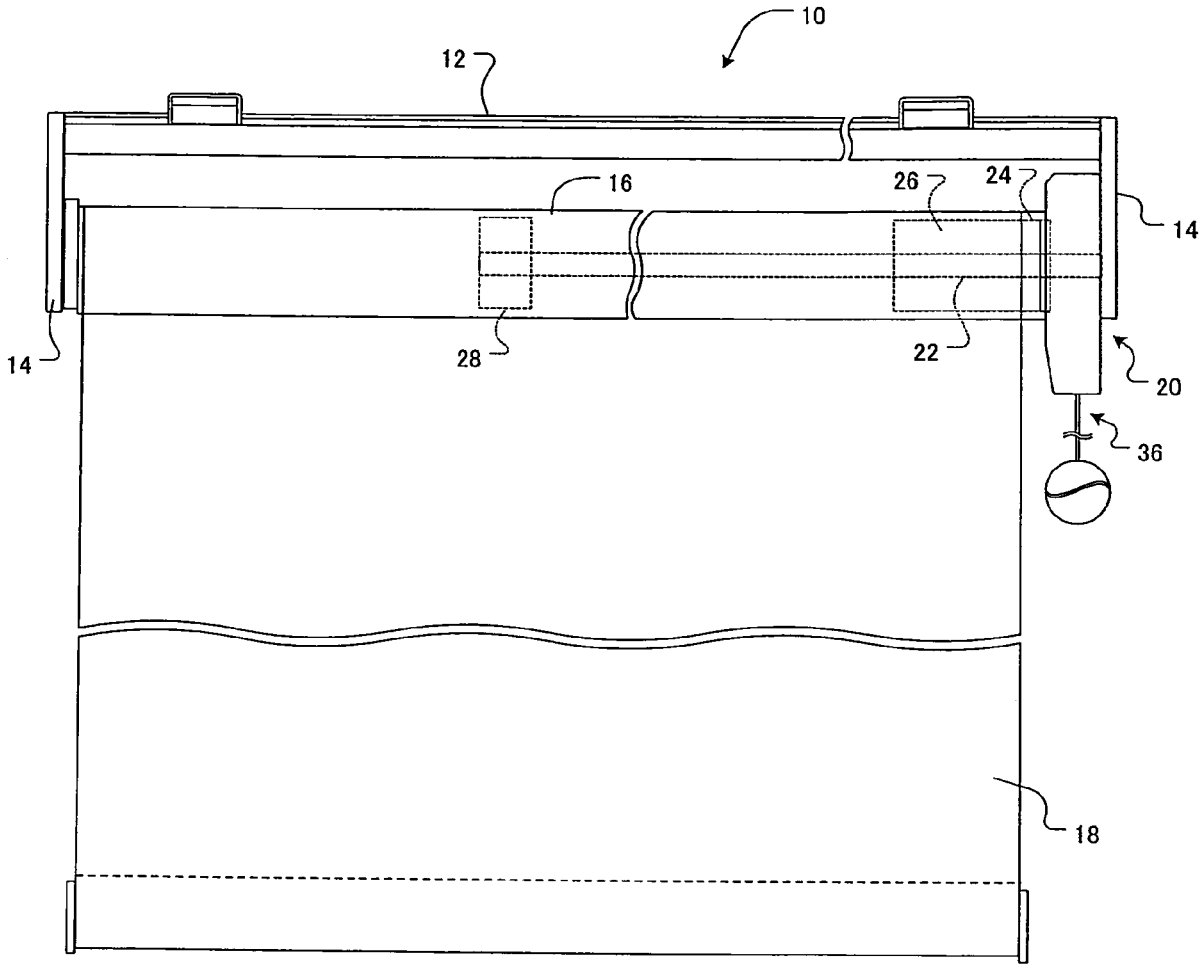
FIG. 1 is an overall front view of a blind of a first preferred embodiment of the present invention.

In FIG. 1, the blind is a roll screen 10 which comprises a set frame 12 fixed to a fixed surface such as a window frame or the like, a pair of supporting plates 14 fitted to respective side ends of the set frame 12, a rolling-up pipe 16 which is a rotation shaft turnably supported to the pair of supporting plates 14, a screen 18 which is a shielding member, and a control section 20 disposed between one end of the rolling-up pipe 16 and one of the supporting plates 14. One end of the screen 18 is connected to the rolling-up pipe 16, and which is hung from the rolling-up pipe 16 so as to be wound around or unwound from the rolling-up pipe 16. The one end of the rolling-up pipe 16 is supported by a supporting shaft 22 extending from the one of the supporting plates 14 into the inside of the rolling-up pipe 16. The supporting shaft 22 is basically fixed relative to the supporting plates 14, however can be turnable relative to the supporting plates 14 only when it is concurrently used for adjusting a lower limit mechanism (not shown). However, since the lower limit mechanism has no essential relevance to the present invention, description of this part will be omitted, and the supporting shaft 22 is supposed to be a basically stationary fixed member within the range of the normal use of the blind 10.

The control section 20 and the rolling-up pipe 16 are linked to each other via a first clutch mechanism 24, and the rolling-up pipe 16 and the supporting shaft 22 are linked via a second clutch mechanism 26. A brake 28 for decelerating the turning of the rolling-up pipe 16 is disposed within the rolling-up pipe 16. The configurations of the control section 20, the first clutch mechanism 24 and the second clutch mechanism 26 will be described in detail below with reference to FIG. 2 through FIG. 11.

Figure 2:
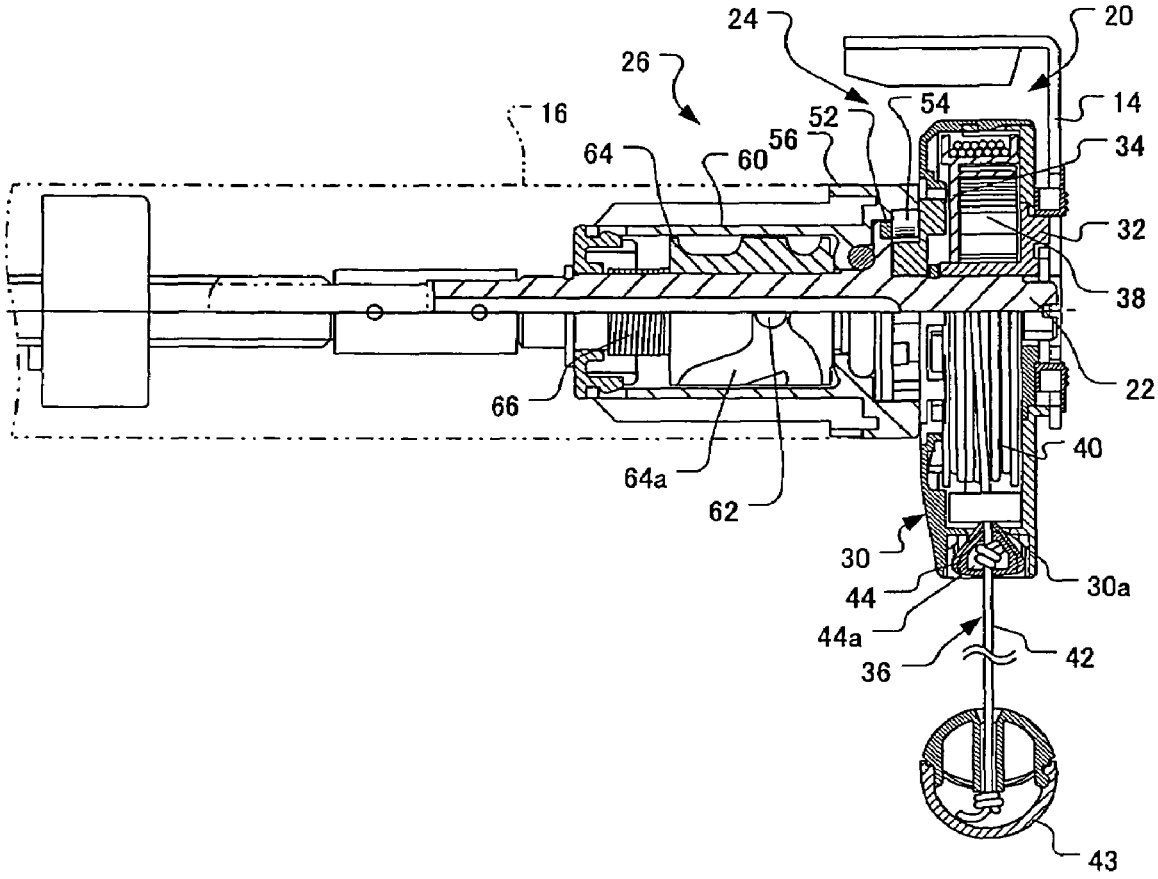
FIG. 2 is a semi sectional view of one end of the blind of FIG. 1.
Figure 3A:
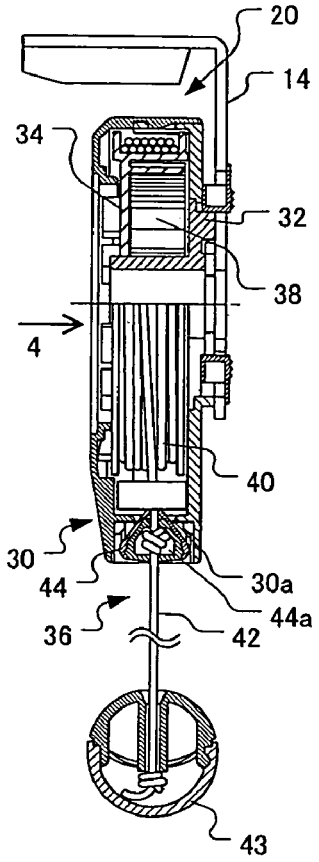
FIG. 3A is a semi sectional view of mainly a control section of the blind of FIG. 1.
Figure 3B:
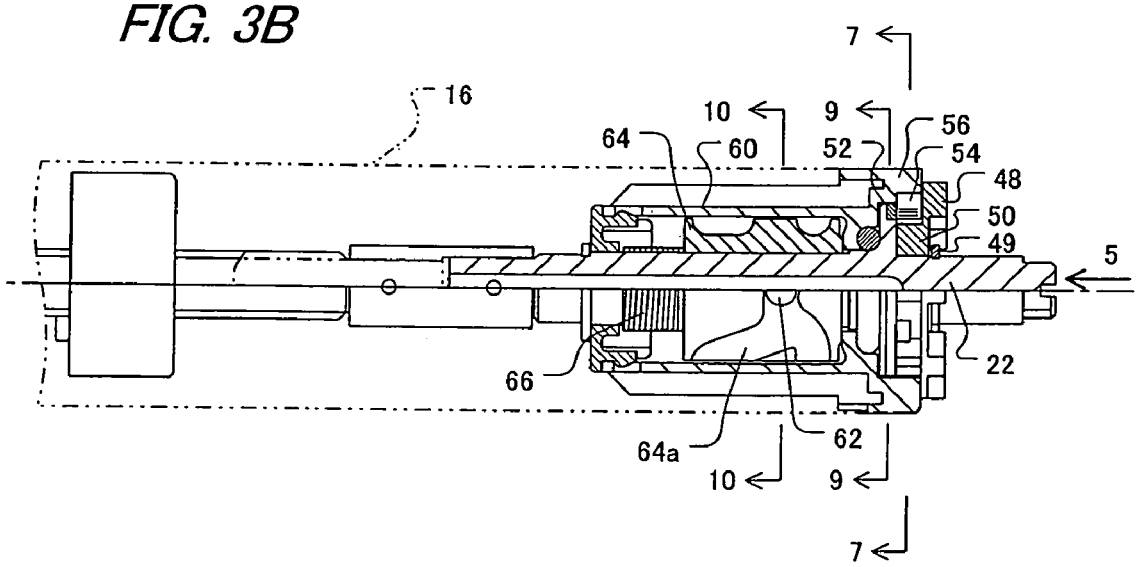
FIG. 3B is a semi sectional view of mainly a first clutch mechanism and a second clutch mechanism of the blind of FIG. 1.

As shown in FIG. 2 and FIG. 3A, the control section 20 includes a control case 30 fixed to the one of the supporting plate 14 with fastenings (not shown), a fixed shaft 32 fixed to the one of the supporting plates 14, a pulley 34 supported to be turnable around the fixed shaft 32, a control member 36 of which one end is attached to the pulley 34 to permit the control member 36 to be wound around and unwound from the pulley 34, and a spiral spring 38 as an urging member, of which one end is fixed to the fixed shaft 32 and the other end is fixed to the pulley 34.

The length of the fixed shaft 32 in its axial direction is short enough to allow the pulley 34 to support thereon, and the supporting shaft 22 coaxially penetrates the fixed shaft 32. The fixed shaft 32 and the supporting shaft 22 cannot turn relative to each other.

In further detail, the control member 36 comprises a rolling-up cord 40 which is directly wound around the pulley 34, a holding cord 42 whose upper end is tied with the lower end of the rolling-up cord 40, an operating knob 43 attached to the lower end of the holding cord 42, and a stopper 44. The stopper 44 is provided with an accommodating portion 44*a* thereinside for accommodating a knot formed between the lower end of the rolling-up cord 40 and the upper end of the holding cord 42 so that the stopper 44 is greater in diameter than the cords 40 and 42. The cords 40 and 42 may be shaped like either thin strings or thin tapes. The control member 36 passes through an opening 30*a* formed in a lower part of the control case 30 and moves in and out of the control case 30, but the stopper 44 cannot pass the opening 30*a* and comes into contact with the control case 30 around the opening 30*a*. Therefore, part of the holding cord 42 is always hanging down below the control case 30, thereby preventing the control member 36 from being excessively wound around the pulley 34 and from rising out of the user's reach. Accordingly the suspending length of the holding cord 42 when it is not operated is appropriate not only for the ease of handling by the user but also for keeping the aesthetic appearance of the blind satisfactory and preventing it from catching a passer-by, a pet animal, furniture or the like.

Figure 4:
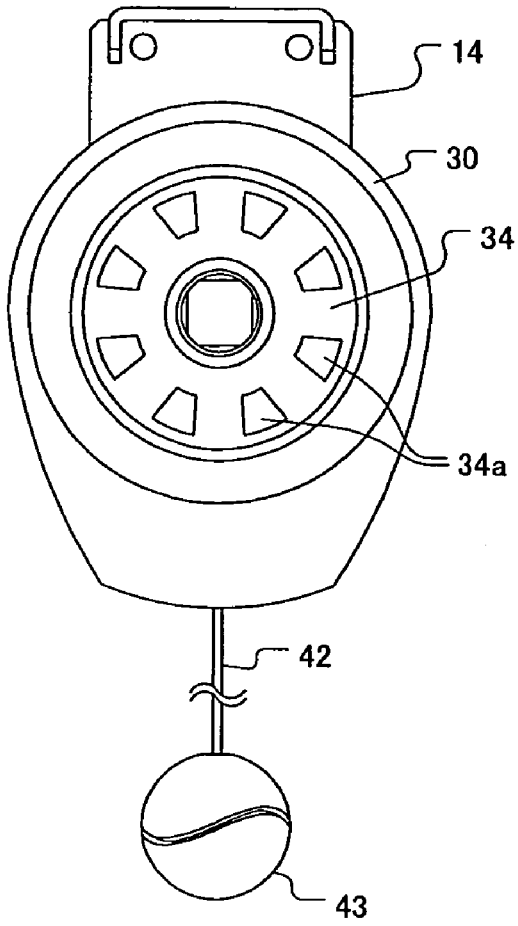
FIG. 4 is a view indicated by arrow 4 in FIG. 3A.

As shown in FIG. 4, a plurality of engaging stubs 34*a* are formed on an end side surface of the pulley 34, facing toward the rolling-up pipe 16. The engaging stubs 34*a* are separated from one another in the circumferential direction along a certain circular contour.

Figure 5:
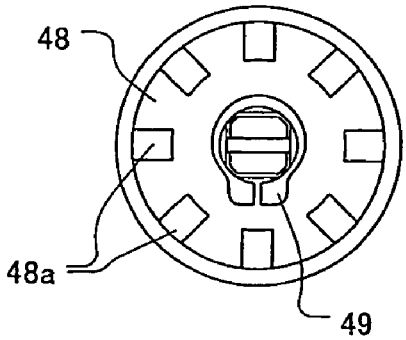
FIG. 5 is a view indicated by arrow 5 in FIG. 3B.
Figure 6:
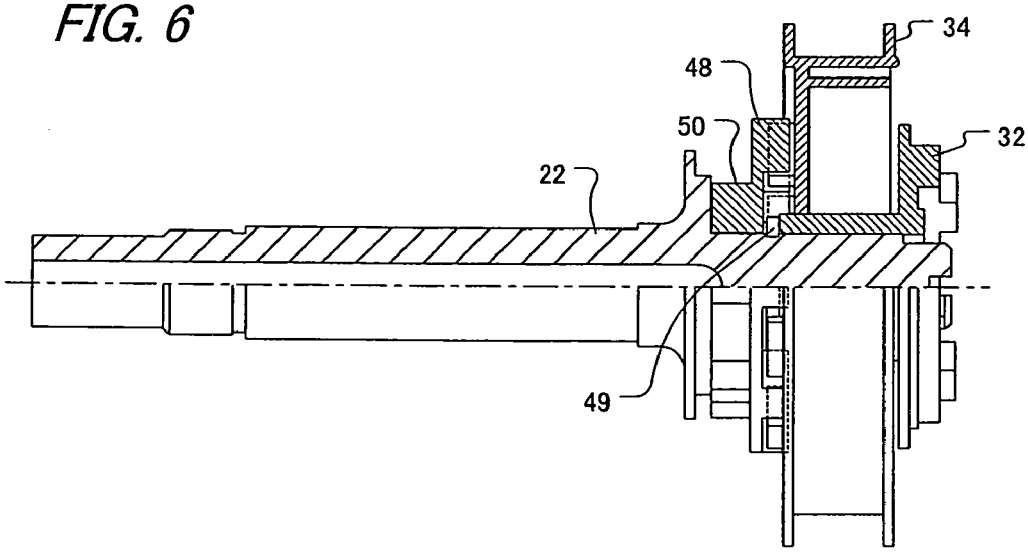
FIG. 6 is a semi sectional view representing the relationship among a pulley, a rotator and a supporting shaft.

These engaging stubs 34*a* engage with engaging stubs 48*a* similarly formed on a rotator 48. The engaging stubs 48*a* are also formed separate from one another in the circumferential direction along a certain circular contour as shown in FIG. 5. As shown in FIG. 6 on an enlarged scale, the position of the rotator 48 in the axial direction relative to the supporting shaft 22 is restricted by a washer 49 so that, when the engaging stubs 48*a* of the rotator 48 engage with the engaging stubs 34*a* of the pulley 34, slight clearances are formed between the two sets of engaging stubs in both the circumferential and axial directions.

An input shaft 50 extending into the inside of the rolling-up pipe 16 protrudes from and is integrated with the rotator 48. The above-described first clutch mechanism 24 comprises this input shaft 50, a switch-over guide 52 as a switch-over member, engaging pieces 54, and an output shaft 56. The switch-over guide 52 is on the outer circumference side of the input shaft 50 and can turn relative to the input shaft 50 within a prescribed turning range. The engaging pieces 54 turn together with the switch-over guide 52 and are guided by the switch-over guide 52 to be movable in the radial direction. The output shaft 56 is arranged outside the switch-over guide 52 and coupled to one end of the rolling-up pipe 16. The turning of the pulley 34 in one direction is transmitted to the rolling-up pipe 16, but the turning of the pulley 34 in the other direction is not transmitted to the rolling-up pipe 16. Nor is the turning of the rolling-up pipe 16 transmitted to the pulley 34. The detailed configuration will be described below.

Figure 7:
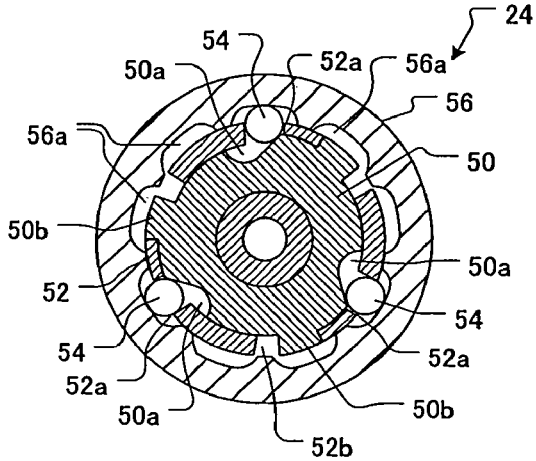
FIG. 7 is a sectional view along line 7-7 in FIG. 3B.

As shown in FIG. 7, a plurality of (three) concave grooves 50*a* and a plurality of (three) ribs 50*b* protruding in the radial direction are alternately formed in/on the circumferential surface of the input shaft 50 so as to be separated at equal intervals in the circumferential direction. A plurality (three) of recessed grooves 52*a* and a plurality (three) of recessed long grooves 52*b* are formed in the switch-over guide 52, respectively separated at equal intervals in the circumferential direction, to correspond to the concave grooves 50*a* and the ribs 50*b*. The ribs 50*b* are inserted into the recessed long grooves 52*b* with clearances in the circumferential direction.

Figure 8:
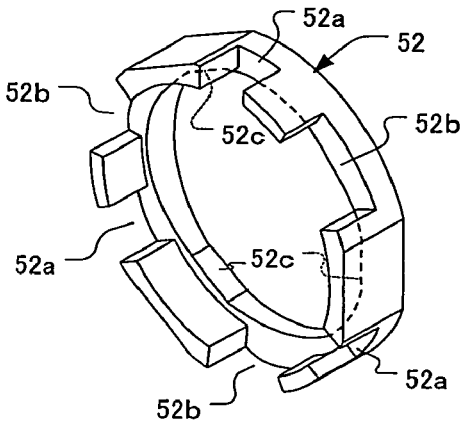
FIG. 8 is a perspective view of a switch-over guide.
Figure 9:
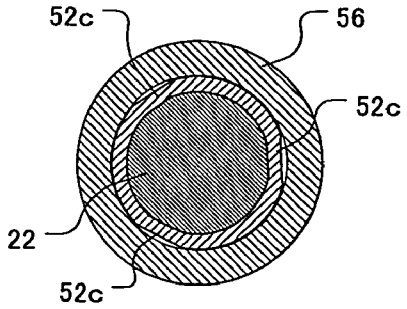
FIG. 9 is a sectional view along line 9-9 in FIG. 3B.

The switch-over guide 52 is turnably supported at a radially enlarged part of the supporting shaft 22. The inner sectional contour of the switch-over guide 52 to be contacted with the supporting shaft 22 preferably has a non circular shape, e.g. has flat surfaces 52*c* which are separated at equal intervals in the circumferential direction and somewhat protrude toward the supporting shaft 22 as shown in FIG. 8 and FIG. 9.

The columnar-shaped engaging piece 54 is inserted into each of the recessed grooves 52*a* of the switch-over guide 52. A plurality (nine) of concave grooves 56*a* are formed in the inner circumferential surface of the output shaft 56. The engaging pieces 54 which are movable in the radial direction in the recessed grooves 52*a*, can be switched over according to a relative angular movement between the switch-over guide 52 and the input shaft 50 between a state in which they are moved inwardly in the concave grooves 50*a* of the input shaft 50 and another state in which they are moved outwardly into the concave grooves 56*a* in the output shaft 56.

A clutch case 60 extending into the inside of the rolling-up pipe 16 is integrally provided on the output shaft 56. The above-described second clutch mechanism 26 comprises this clutch case 60, a slider 62 turning together with the clutch case 60, a clutch drum 64 which restricts the movements of the slider 62, and a clutch spring 66 which allows the clutch drum 64 to turn only in one direction.

Figure 10:
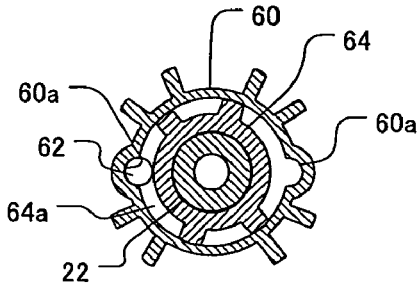
FIG. 10 is a sectional view along line 10-10 in FIG. 3B.

As shown in FIG. 10, concave grooves 60*a* extending in the axial direction are formed in an inner surface of the clutch case 60, and part of the slider 62 is inserted into one of the concave grooves 60*a* to be movable in the axial direction. The clutch drum 64 is formed with a guide groove 64*a*. The rest part of the slider 62 is inserted into the guide groove 64*a* which guides the movement of the slider 62.

Figure 11:
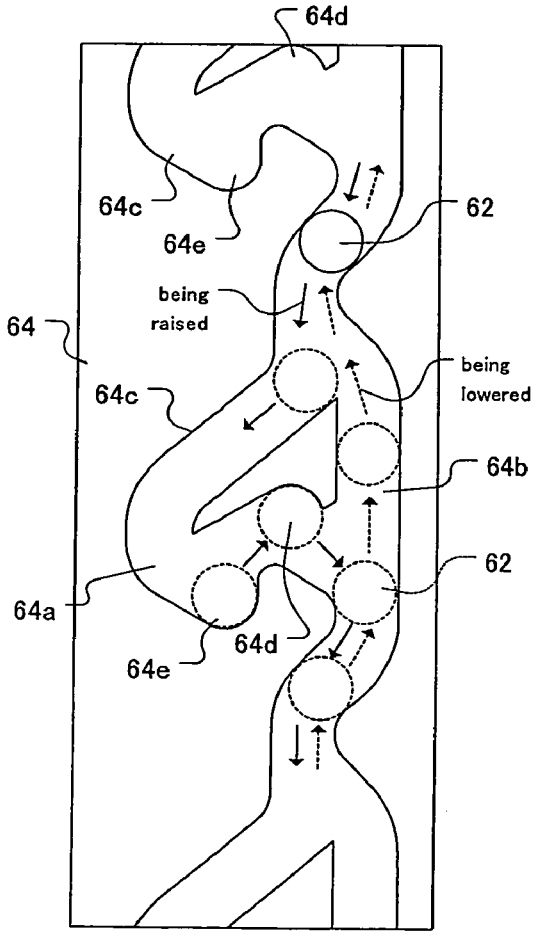
FIG. 11 is a development view of a clutch drum.

As shown in FIG. 11, the guide groove 64*a* has one endless groove portion 64*b* and two branch groove portions 64*c* branching out of the endless groove portion 64*b*. An engaging portion 64*e* and a stop portion 64*d* are formed within each of the branch groove portions 64*c*. The clutch spring 66 is wound around the supporting shaft 22, and one end of it is connected to the clutch drum 64.

The operation of the blind configured as described above will now be described.

In a state in which the screen 18 is stopped by the action of the second clutch mechanism 26, the own weight of the screen 18 is acting on the output shaft 56 through the rolling-up pipe 16, and the slider 62 inserted into the clutch case 60 integrated with the output shaft 56 is positioned at the stop portion 64*d*. Although the slider 62 works to push the clutch drum 64 at the stop portion 64*d* in a direction corresponding to the direction of dropping the screen 18, the clutch spring 66 is fastened to inhibit the clutch drum 64 from turning in the direction. As a result, the rolling-up pipe 16 is linked to the supporting shaft 22 to remain at halt.

Figure 12:
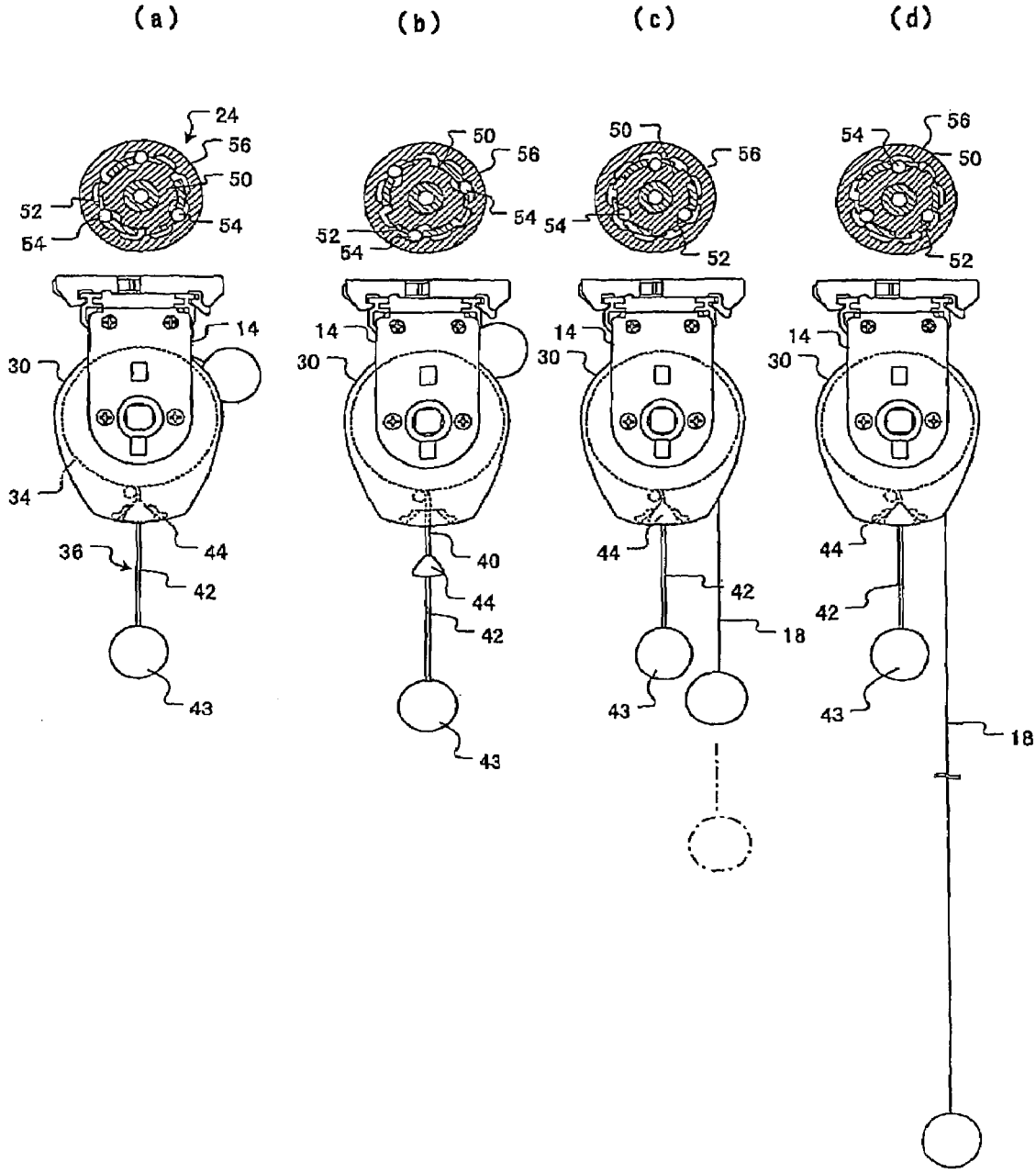
FIG. 12 shows side views and sectional views equivalent to FIG. 7, showing the operation of the blind when its screen is lowered.

At this time, the rolling-up cord 40 of the control member 36 is wound around the pulley 34, and the stopper 44 is in contact with the control case 30 (FIG. 12(*a*)).

When the screen 18 is to be lowered, for instance, from this state, the user pulls the holding cord 42 of the control member 36 to a prescribed extent (FIG. 12(*b*)). Then, the rolling-up cord 40 of the control member 36 is unwound from the pulley 34 and drawn out of the control case 30, and the pulley 34 rotates in the unwinding direction.

When the pulley 34 rotates, the rotation of the pulley 34 is transmitted to the rotator 48 with a slight delay, and further transmitted to the input shaft 50 of the first clutch mechanism 24. When the input shaft 50 rotates, the switch-over guide 52 and the engaging pieces 54 rotate and the output shaft 56 is also rotated by the engaging pieces 54.

Then in the second clutch mechanism 26, the rotation of the clutch case 60 integrated with the output shaft 56 causes the slider 62 to start from the stop portion 64*d* of the clutch drum 64 and to move to the endless groove portion 64*b*. When the user withdraws his or her hand from the holding cord 42 in this state, the pulley 34 is rotated by the spiral spring 38 in the direction of winding the rolling-up cord 40. This rotation of the pulley 34 is transmitted to the input shaft 50 via the rotator 48. The rotation of the input shaft 50 relative to the switch-over guide 52 causes the engaging pieces 54 to move into the concave grooves 50*a* in the input shaft 50, and the linkage between the input shaft 50 and the output shaft 56 is undone (FIG. 12(*c*)).

As a result, the output shaft 56 is relieved of linkage to both the pulley 34 and the supporting shaft 22 by the first clutch mechanism 24 and the second clutch mechanism 26. The pulley 34 is turned by the spiral spring 38 in the direction of winding the rolling-up cord 40, the rolling-up pipe 16 is turned by the own weight of the screen 18 in the direction of unwinding the screen, and the pulley 34 and the rolling-up pipe 16 are turned independently of each other, though in the same direction. The pulley 34 winds the rolling-up cord 40 as much as possible, i.e. until the stopper 44 comes into contact with the control case 30. The pulley 34 then stops, but the output shaft 56 and the rolling-up pipe 16 continue to turn. In this way, the screen 18 descends by its own weight under deceleration by the brake 28, and stops when it reaches its lower limit (FIG. 12(*d*)).

When the pulley 34 is at halt and the output shaft 56 and the rolling-up pipe 16 continue turning, if the switch-over guide 52 in contact with the output shaft 56 turned together with the output shaft 56, the switch-over guide 52 and the input shaft 50 would turn relative to each other to cause the engaging pieces 54 to move to the output shaft 56 and the pulley 34 and the output shaft 56 to be linked with each other, and the output shaft 56 could no longer continue turning, resulting in faulty operation. However, in this embodiment, since the switch-over guide 52 is held by the flat surfaces 52*c* relative to the supporting shaft 22 with a force stronger than the turning force of the output shaft 56 but weaker than the urging force of the spiral spring 38, the switch-over guide 52 does not turn following the output shaft 56 while the pulley 34 is not turning but the output shaft 56 is turning.

Figure 13A:
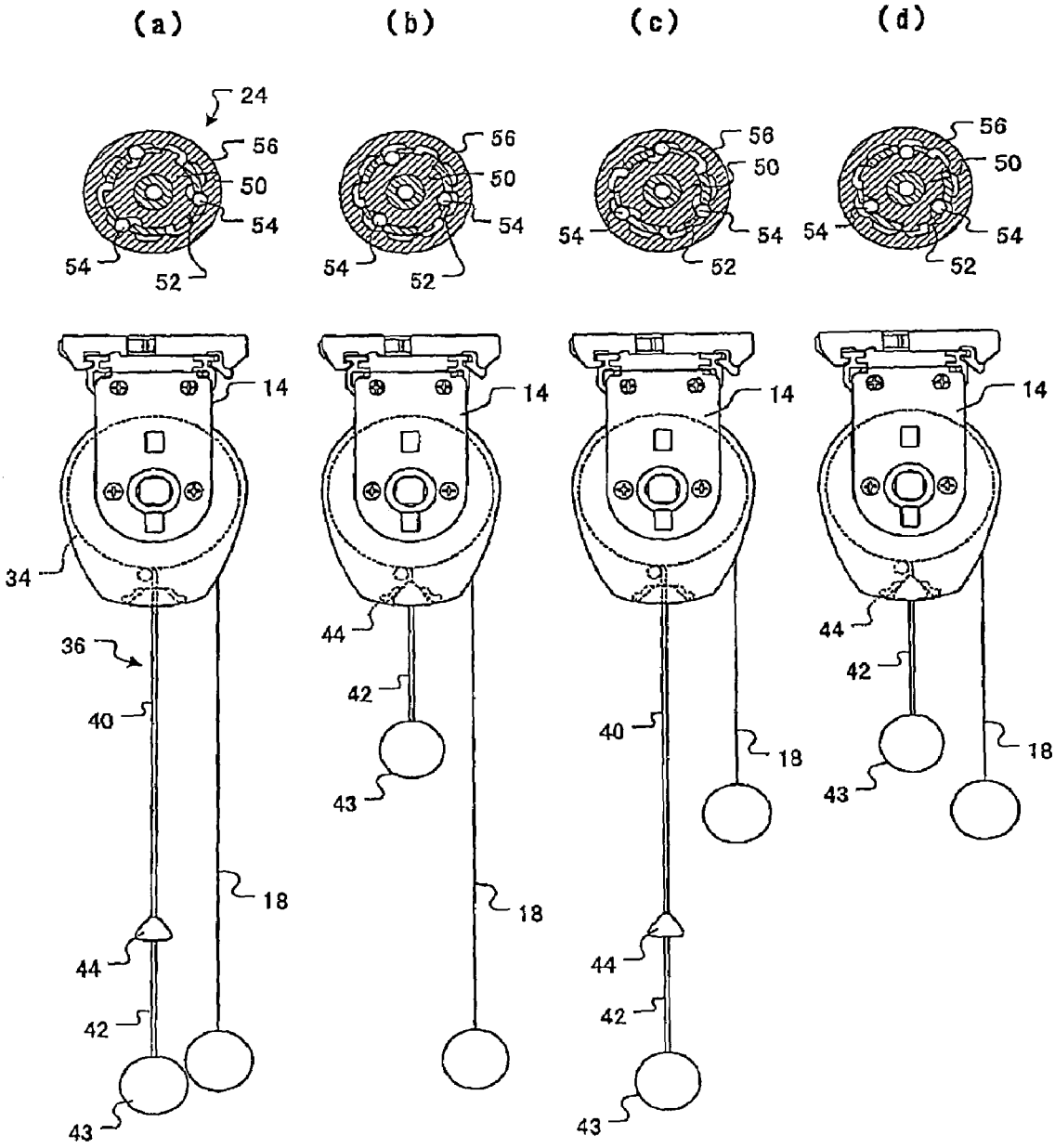
FIG. 13A shows side views and sectional views equivalent to FIG. 7, showing the operation of the blind when its screen is raised.

Next, when the screen 18 is to be raised, the user can keep pulling the holding cord 42 of the control member 36 (FIG. 13A(a)). Then, the rolling-up cord 40 of the control member 36 is unwound from the pulley 34 to be pulled out of the control case 30, and the pulley 34 turns in the unwinding direction.

When the pulley 34 rotates, the rotation of the pulley 34 is transmitted to the rotator 48 with a slight delay, and further transmitted to the input shaft 50 of the first clutch mechanism 24. When the input shaft 50 rotates relative to the switch-over guide 52, the engaging pieces 54 move outwardly to link the input shaft 50 and the output shaft 56 with each other to cause the output shaft 56 via the engaging pieces 54 to turn.

Then in the second clutch mechanism 26, the rotation of the clutch case 60 integrated with the output shaft 56 causes the slider 62 to enter into one of the branch groove portions 64*c* from the endless groove portion 64*b* of the clutch drum 64, and moves to the engaging portion 64*e*. At the engaging portion 64*e*, the slider 62 so acts as to turn the clutch drum 64 in a direction matching the raising direction of the screen, and the loosening of the clutch spring 66 allows the clutch drum 64 to turn in the raising direction.

As a result, the rotation of the pulley 34 is transmitted by the first clutch mechanism 24 to the output shaft 56, which is unlinked from the supporting shaft 22 by the second clutch mechanism 26, the rolling-up pipe 16 is turned in the direction. of rolling up the screen correspondingly to the rotation of the pulley 34, and the screen 18 is thereby raised.

Since the rolling-up cord 40 of the control member 36 is limited in length, it cannot be pulled out after it has been pulled to the maximum. When the control member 36 is then released, the spiral spring 38 causes the rolling-up cord 40 to be wound by the pulley 34 (FIG. 13A(b)). Thus, while the pulley 34 rotates in the direction of winding the rolling-up cord 40, this rotation of the pulley 34 is transmitted to the input shaft 50 via the rotator 48, and the resultant rotation of the input shaft 50 relative to the switch-over guide 52 causes the engaging pieces 54 to move inwardly into the concave grooves 50*a* of the input shaft 50, resulting in unlinking of the input shaft 50 and the output shaft 56 from each other. Therefore, the rotation of the pulley 34 in the direction of winding the rolling-up cord 40 is not transmitted to the output shaft 56. In the second clutch mechanism 26, the own weight of the screen 18 causes the slider 62 to move from the engaging portion 64*e* to the stop portion 64*d* to link the rolling-up pipe 16 and the supporting shaft 22 with each other to stop the screen.

Figure 13B:
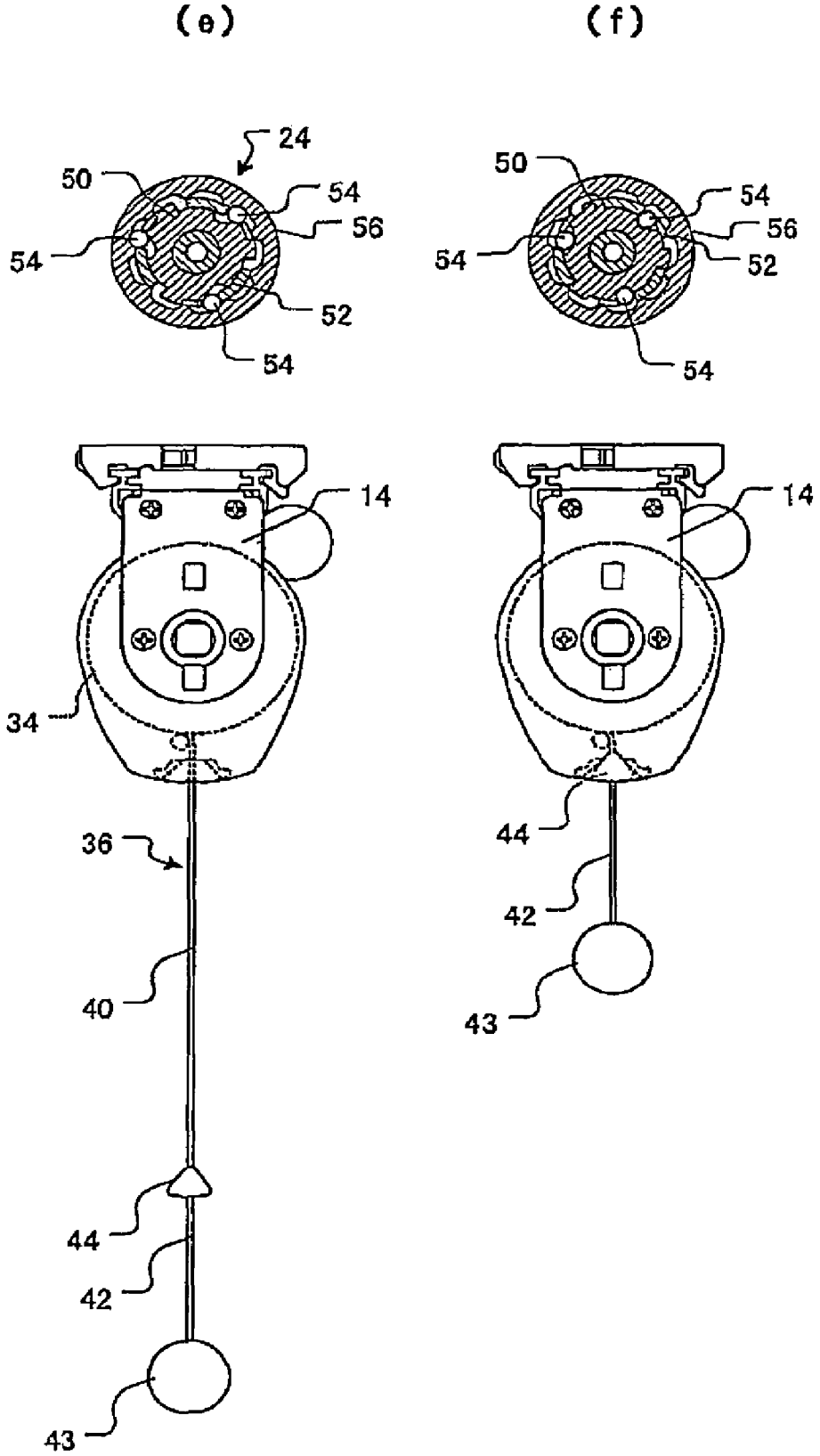
FIG. 13B shows views sequential to FIG. 13A.

When the screen 18 is desired to be raised further, the control member 36 whose rolling-up cord 40 has been wound up by the pulley 34 is pulled out again. The actions illustrated in FIG. 13A(c) through FIG. 13B(d) are repeated until the screen 18 is raised to a desired height. By repeating the pulling-out action of the control member 36, the screen 18 can be raised to its upper limit (FIGS. 13B(e) and (f)).

Incidentally, in this embodiment of the invention, when it is desired to stop the screen 18 dropping due to its own weight at a desired height, there are two methods to stop the screen. The first method is to utilize the second clutch mechanism 26 to link the rolling-up pipe 16 and the supporting shaft 22 together. The second method is to utilize the first clutch mechanism 24 to link the rolling-up pipe 16 and the pulley 34 together.

When the screen 18 is to be stopped by the first method, the control member 36 is drawn out in a long stroke. This causes the slider 62 which is moving in the endless groove portion 64*b* of the clutch drum 64 and rounding along the endless groove portions 64*b* with turning of the output shaft 56, to move from the endless groove portion 64*b* into one of the branch groove portion 64*c* and then reach the engaging portion 64*e*. When the control member 36 is released, the slider 62 moves from the engaging portion 64*e* to the stop portion 64*d* and therefore the rolling-up pipe 16 and the screen 18 stop.

Figure 14:
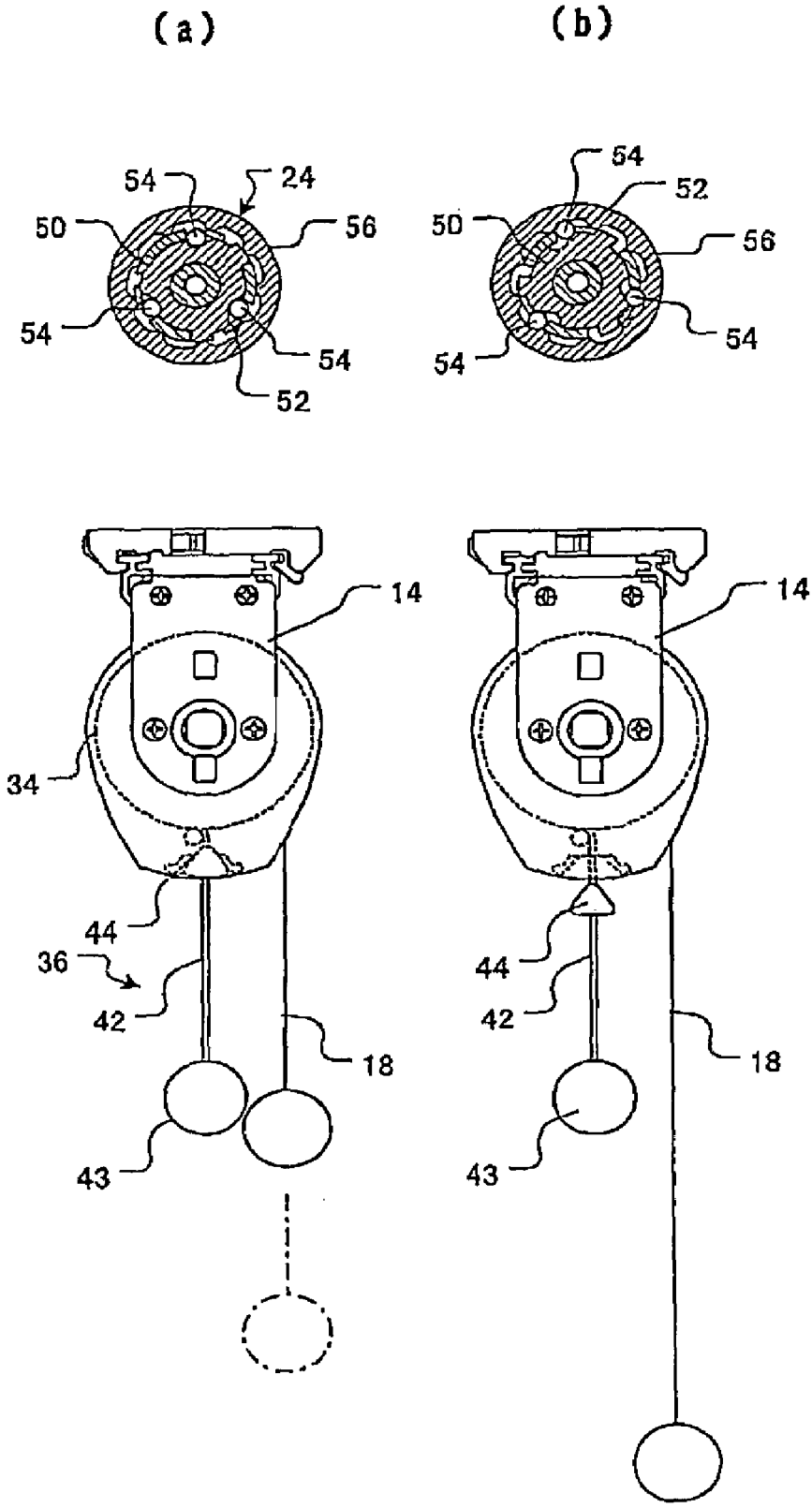
FIG. 14 shows side views and sectional views equivalent to FIG. 7, showing the operation of the blind when its screen is stopped on the way of its descent.

When the screen 18 is to be stopped by the second method, the control member 36 is drawn out in a short stroke (FIG. 14(*b*)). This causes the rotation of the pulley 34 to be transmitted to the input shaft 50, the switch-over guide 52 turns and the engaging pieces 54 move outward to engage with the concave grooves 56*a* of the output shaft 56. As a result, the pulley 34 and the turning output shaft 56 are linked with each other. Just after that, the pulley 34 begins to turn in the reverse direction, namely in the direction of winding the rolling-up cord 40. At this time, since the turning direction of the pulley 34 and that of the output shaft 56 are coincident with each other, the pulley 34 rotates with being linked with the rolling-up pipe 16. When the stopper 44 of the control member 36 comes into contact with the control case 30 to make it impossible for the pulley 34 to turn in the direction of winding the rolling-up cord 40, the rolling-up pipe 16 is also made unable to turn. Thus, the rolling-up pipe 16 and the screen 18 stop.

To compare the first method and the second method, the two stop portions 64*d* are formed in the circumferential direction on the clutch drum 64 in the second clutch mechanism 26, whereas the nine concave grooves 56*a* of the output shaft 56 are formed in the circumferential direction in the first clutch mechanism 24. This means that the first clutch mechanism 24 can link the pulley 34 and the rolling-up pipe 16 with each other and stop them in a smaller turning angle, and accordingly the second method serves to shorten the rising height of the screen 18 from the time the control member 36 is operated until the screen 18 actually stops, making it possible to stop the screen 18 more quickly and at a desired height.

It is also possible, when the screen 18 is dropping by its own weight, keeping on pulling the control member 36 allows the rolling-up pipe 16 to turn in the direction of winding the screen correspondingly to the rotation of the pulley 34 and thereby raising the screen 18.

The control member 36 in this embodiment is drawn out of the pulley 34 only when it is to be operated as described above. It is immediately wound up by the spiral spring 38 upon completion of each round of operation, the control member 36 does not hang long, and can be prevented from catching a passer-by, a pet animal or furniture.

Additionally, though the pulley 34 and the first clutch mechanism 24 are coupled with each other via the rotator 48 in the above-described embodiment, it is also possible to integrate the pulley 34 and the input shaft 50 with each other without the rotator 48. It is also conceivable to configure the fixed shaft 32 and the supporting shaft 22 integrally. However, in the case of that the supporting shaft 22 or the like is bent by the weight of the screen 18 to incline the first clutch mechanism 24, it is possible to prevent the inclination and bend from being transmitted to the pulley 34 and the spiral spring 38 urging the pulley 34 from running into faulty operation because the rotator 48 as in this embodiment is disposed to leave slight clearances in the circumferential direction and the axial direction between the engaging stubs 34*a* of the pulley 34 and the engaging stubs 48*a* of the rotator 48, and/or because the pulley 34 is supported by the fixed shaft 32 separate from and shorter than the supporting shaft 22.

Second Embodiment

Figure 15:
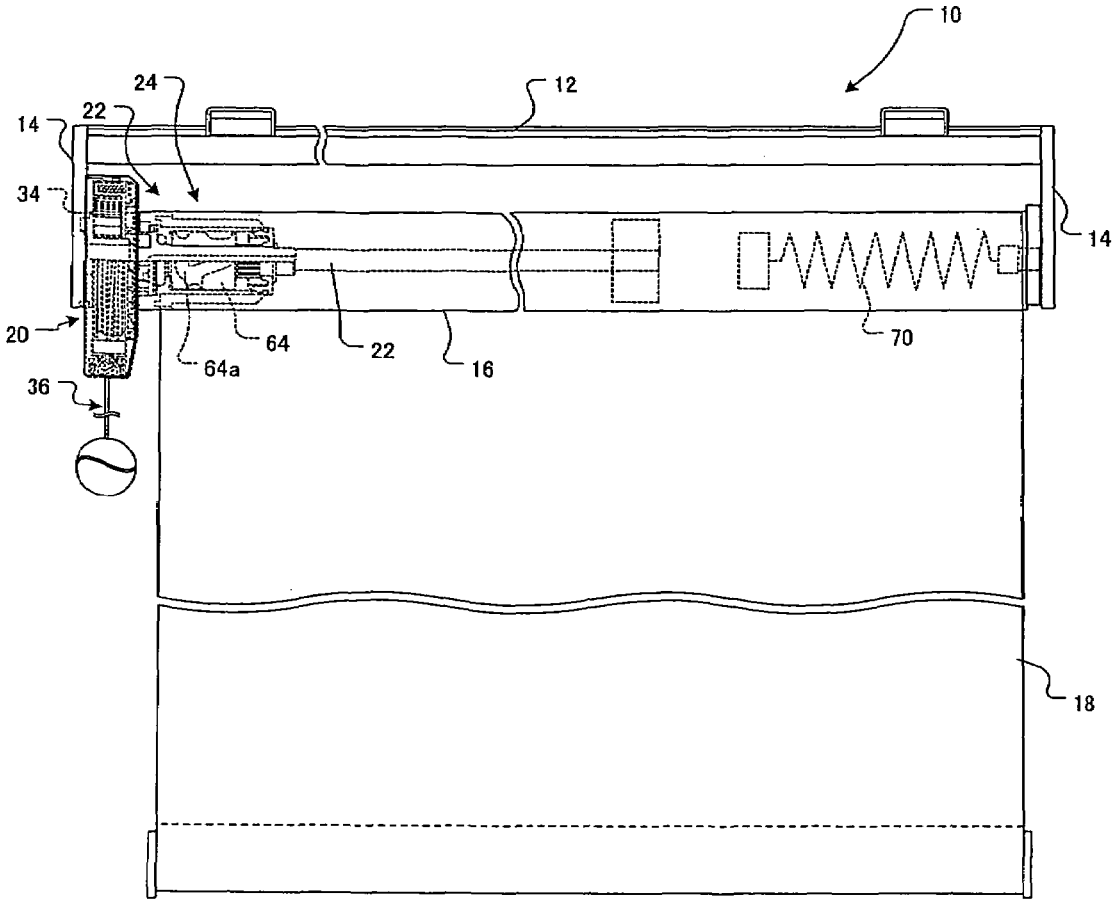
FIG. 15 is an overall front view of a blind, of a second preferred embodiment of the invention.

FIG. 15 shows an overall front view of a second preferred embodiment of the present invention. It is different from the first embodiment wherein the screen 18 descends by its own weight when the rolling-up pipe 16 is unlinked from the supporting shaft 22 by the second clutch mechanism 26, in that a rolling-up spring 70 is arranged in the rolling-up pipe 16 to urge all the time the rolling-up pipe 16 in the direction of winding the screen. This embodiment can be accomplished by vertically inverting the guide groove 64*a* of the clutch drum 64 in the second clutch mechanism 26 as it is shown in the development view of the first embodiment.

In this arrangement, turning the pulley 34 to turn the rolling-up pipe 16 via the first clutch mechanism 24 allows the rolling-up pipe 16 to turn in the direction of unwinding the screen against the winding force of the rolling-up spring 70 and the screen 18 to be lowered. Also, the screen 18 can be stopped by having the second clutch mechanism 26 link the rolling-up pipe 16 and the supporting shaft 22 with each other. When the second clutch mechanism 26 unlinks the rolling-up pipe 16 and the supporting shaft 22 from each other in response to the rotation of the pulley 34 by a prescribed angle, the screen 18 is raised by the winding force of the rolling-up spring 70. It is also possible to stop the rising screen 18 by the action of the first clutch mechanism 24 or the second clutch mechanism 26.

This embodiment also provides similar actions and effects to those of the first embodiment.

Third Embodiment

Figure 16:
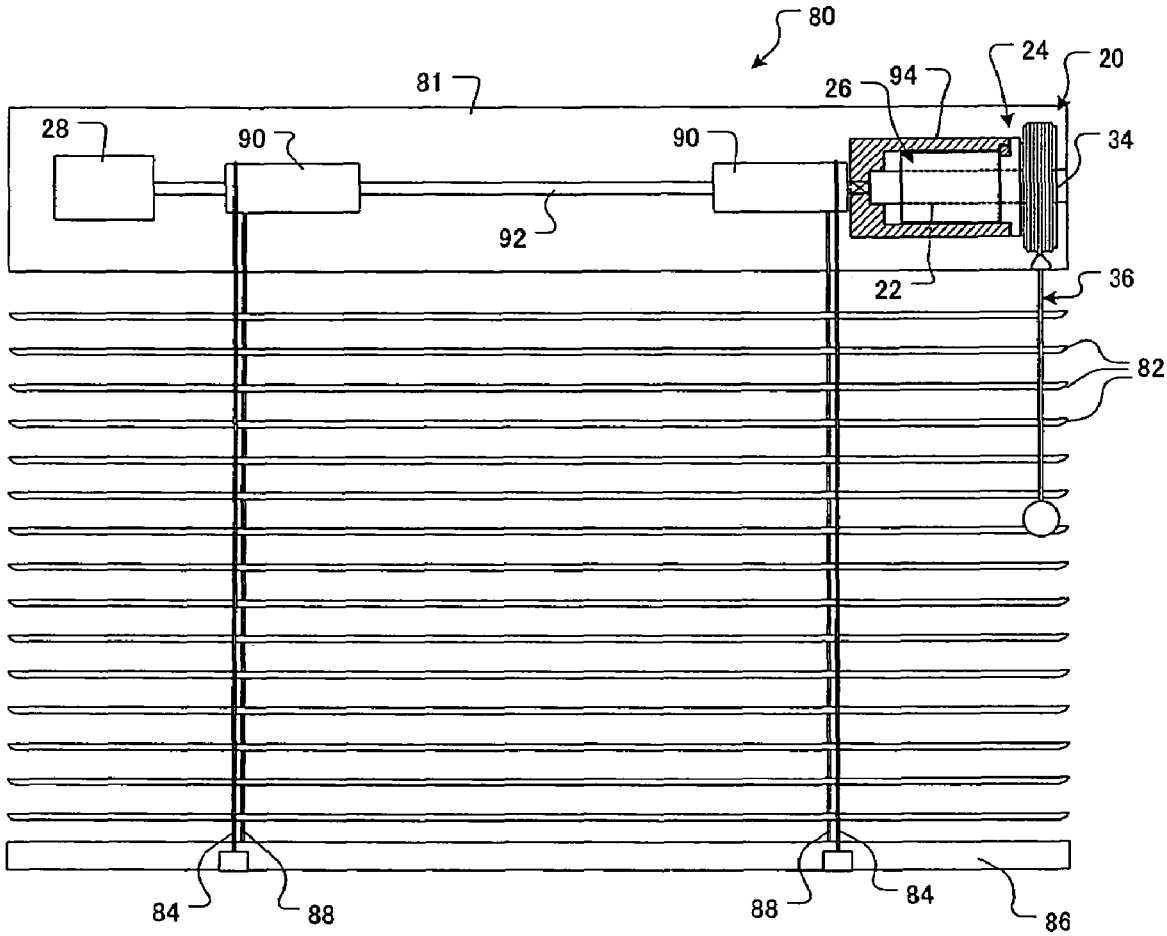
FIG. 16 is an overall front view of a blind, of a third preferred embodiment of the invention.

FIG. 16 shows a third preferred embodiment of the present invention. This embodiment constitutes an application of the invention to a horizontal blind 80, wherein many slats 82 serving as a shielding member hang from a head box 81 and are aligned vertically and supported by ladder cords 84. Further, lifting cords 88 penetrate the slats 82 and bottom ends of the lifting cords 88 are attached to a bottom rail 86 disposed underneath the slats 82. Upper ends of the ladder cords 84 and of the lifting cords 88 are connected to drums 90 disposed within the head box 81. The ladder cords 84 turn together with the drums 90 within a prescribed range of angles, and outside that range the ladder cords 84 do not turn with the drums 90. The lifting cords 88 can be wound around and unwound from the drums 90. The drums 90 are mounted on a rotation shaft 92 extending within the head box 81 in the lengthwise direction so as to unturnable relative to the rotation shaft 92. The rotation shaft 92 is connected to a follower 94 as a rotation shaft, so as to be unturnable relative to the follower 94.

The control section 20 having a pulley 34, a control member 36 and a spiral spring 38 is disposed at one end of the head box 81. The control section 20 and the follower 94 are linked with each other via the first clutch mechanism 24, while the follower 94 and the supporting shaft 22 are linked with each other via the second clutch mechanism 26. The follower 94 here can be integrated with the output shaft 56 of the first clutch mechanism 24 and the clutch case 60 of the second clutch mechanism 26. The brake 28 is connected to one end of the rotation shaft 92. The configurations of the control section 20, the first clutch mechanism 24 and the second clutch mechanism 26 are the same as their respective counterparts in the first embodiment.

Therefore, their actions are the same as those of their respective counterparts in the first embodiment. Turning the pulley 34 to turn the follower 94 via the first clutch mechanism 24 allows the follower 94 to turn in the direction of winding the lifting cords thereby winding the lifting cords 88 around the drums 90 and raising the slats 82. Also, the slats 82 can be stopped by having the second clutch mechanism 26 link the follower 94 and the supporting shaft 22 with each other. The slats 82 can descend because of their own weight when the second clutch mechanism 26 unlinks the follower 94 and the supporting shaft 22 from each other in response to the rotation of the pulley 34 by a prescribed angle. The slats 82 descending by their own weight can be stopped by operating the first clutch mechanism 24 or the second clutch mechanism 26.

This embodiment also provides similar effects to those of the first embodiment.

Fourth Embodiment

Figure 17:
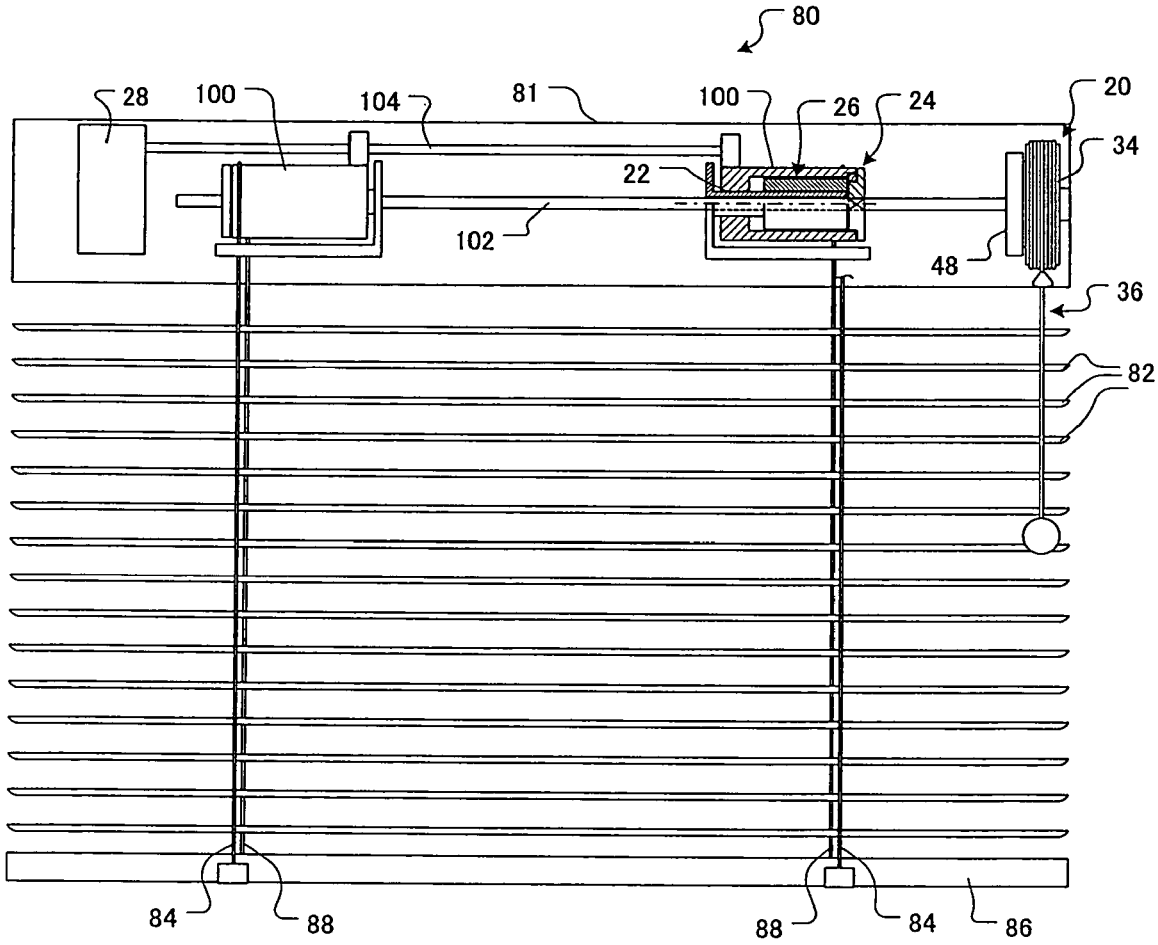
FIG. 17 is an overall front view of a blind, of a fourth preferred embodiment of the invention.

FIG. 17 shows a fourth embodiment of the present invention. The same or similar members as or to those in previous embodiments are denoted by respectively the same reference signs.

This embodiment is another example of application to a horizontal blind, wherein many slats 82 serving as a shielding member hang from a head box 81 and are aligned vertically and supported by ladder cords 84. Further, lifting cords 88 penetrate the slats 82 and bottom ends of the lifting cords 88 are attached to a bottom rail 86 disposed underneath the slats 82. Upper ends of the ladder cords 84 and of the lifting cords 88 are connected to drums 100 as rotation shafts, disposed within the head box 81. The ladder cords 84 turn together with the drums 100 within a prescribed range of angles, and outside that range the ladder cords 84 do not turn with the drums 100. The upper ends of the lifting cords 88 are so connected to the drums 100 as to permit the lifting cords to be wound up and unwound from the drums 100.

The first clutch mechanism 24 and the second clutch mechanism 26 are disposed within each of the drums 100. Each of the drums 100 here can be integrated with the output shaft 56 of the first clutch mechanism 24 and the clutch case 60 of the second clutch mechanism 26. Each of the drums 100 and the second clutch mechanism 26 and the first clutch mechanism 24 are rotatably supported by the supporting shaft 22 fixed to the head box 81. The input shaft 50 of the first clutch mechanism 24 is unturnably connected to a rotation shaft 102 extending within the head box 81 in the lengthwise direction, and the rotation shaft 102 is connected to the pulley 34 of the control section 20 via the rotator 48. In this example, the rotator 48 and the input shaft 50 are separate units and are coupled with each other via the rotation shaft 102.

Each of the drums 100 meshes with a gear fixed to a common auxiliary shaft 104, and the rotation of each drum 100 is synchronized with that of the auxiliary shaft 104. The brake 28 is connected to one end of the auxiliary shaft 104. The configurations of the control section 20, the first clutch mechanism 24 and the second clutch mechanism 26 are the same as those of their respective counterparts in the first embodiment or the third embodiment.

Accordingly, their actions are also the same as those of their respective counterparts in the first embodiment or the third embodiment. Turning the pulley 34 to turn the drums 100 via the first clutch mechanism 24 allows the drums 100 to turn in the direction of winding the lifting cords thereby winding the lifting cords 88 around the drums 100 and raising the slats 82. Also, the slats 82 can be stopped by having the second clutch mechanism 26 link the drums 100 and the supporting shaft 22 with each other, and the slats 82 can descend because of their own weight when the second clutch mechanism 26 unlinks the drums 100 and the supporting shaft 22 from each other in response to the rotation of the pulley 34 by a prescribed angle. The slats 82 descending by their own weight can be stopped by operating the first clutch mechanism 24 or the second clutch mechanism 26.

This embodiment also provides similar effects to those of the first embodiment and the third embodiment.

Although the third and fourth embodiments are examples of application of the present invention to horizontal blinds, the invention can as well be applied to other desired types of blinds including pleated screens and Roman shades.

While the principles of the invention have been described above in connection with specific embodiments, and particular modifications thereof, it is to be clearly understood that this description is made only by way of example and not as a limitation on the scope of invention.

What is claimed is:

1. A blind having a shielding member coupled to a rotation shaft and in which the shielding member is raised and lowered upon rotation of the rotation shaft, the blind comprising:

a pulley;

a control member of which one end is connected to the pulley, the control member capable of being wound around and unwound from the pulley;

an urging member providing an urging force on the pulley in the direction of winding the control member;

a first clutch mechanism which is disposed between the rotation shaft and the pulley, the first clutch mechanism capable of linking the pulley and the rotation shaft with each other to transmit the rotation of the pulley to the rotation shaft, or the first clutch mechanism capable of interrupting the link between the pulley and the rotation shaft to interrupt the transmission of the rotation of the pulley to the rotation shaft; and a second clutch mechanism, the second clutch mechanism capable of linking the rotation shaft and a fixed member with each other, or the second clutch mechanism capable of interrupting the link between the rotation shaft and the fixed member, wherein:

action on the control member and rotation of the pulley engages the first clutch mechanism to rotate the rotation shaft in one direction; another action on the control member and rotation of the pulley at a prescribed angle engages the second clutch mechanism to interrupt the link between the rotation shaft and the fixed member and enables the rotation shaft to rotate in the other direction; and another action on the control member and rotation of the pulley engages the first clutch mechanism or the second clutch mechanism to stop rotation of the rotation shaft while the rotation shaft is rotating in the other direction.

2. The blind according to claim 1, wherein:

said pulley is supported to and turnable around a fixed shaft, and said fixed member includes a supporting shaft which is not turnable relative to the fixed shaft.

3. The blind according to claim 1, wherein:

after engagement of the first clutch mechanism and the rotation shaft has stopped rotating in one direction the second clutch mechanism is engaged to link the rotation shaft and the fixed member with each other to keep the rotation shaft stationary; and wherein, by action on the control member and turning of the pulley, the first clutch mechanism is engaged to stop the rotation shaft from rotating in the other direction.

4. The blind according to claim 1, wherein:

said control member includes a stopper greater in diameter than the control member that restricts the length of the control member wound up by the pulley.

5. The blind according to claim 1, wherein said first clutch mechanism comprises a switch-over guide capable of turning relative to the pulley within a prescribed range of rotational angles and an engaging member which turns together with the switch-over guide and is guided by the switch-over guide to move in the radial direction, the engaging member movable to a position where it transmits the rotation of the pulley to the rotation shaft or to a position where it does not transmit the rotation of the pulley to the rotation shaft depending on the rotational angle between the switch-over guide and the pulley, and wherein the switch-over guide is held by the fixed member with a force stronger than a rotational force received from the rotation shaft and weaker than an urging force received from said urging member.

6. The blind according to claim 1, wherein said first clutch mechanism comprises a switch-over guide capable of turning relative to the pulley within a prescribed range of rotational angles and an engaging member which turns together with the switch-over guide and is guided by the switch-over guide to move in the radial direction, the engaging member movable to a position where it transmits the rotation of the pulley to the rotation shaft or to a position where it does not transmit the rotation of the pulley to the rotation shaft depending on the rotational angle between the switch-over guide and the pulley, and wherein the switch-over guide cannot turn when the rotation shaft is rotating in the other direction and can turn together with the pulley when the pulley is turned by the urging member in the direction of winding up the control member.

7. The blind according to claim 1, wherein the rotation of said rotation shaft in the other direction is the direction in which the shielding member descends by its own weight.

8. The blind according to claim 1, further comprising:

a spring for urging said rotation shaft to turn in a direction corresponding to the ascending direction of the shielding member, wherein:

the rotation of said rotation shaft in the other direction corresponds to the direction in which the shielding member is urged by the spring to ascend.

9. The blind according to claim 1, wherein:

said rotation shaft is a rolling-up pipe to which one end of the shielding member is connected so as to permit the shielding member to be wound and unwound from the rolling-up pipe.

10. The blind according to claim 1, wherein:

said rotation shaft is either a drum to which one end of a lifting cord, of which the other end is connected to the bottom of the shielding member, is connected so as to permit the lifting cord to be wound around and unwound from the drum, or a member unturnably connected to a drum to which one end of a lifting cord, of which the other end is connected to the bottom of the shielding member, is connected so as to permit the lifting cord to be wound around and unwound from the drum.

11. A blind having a shielding member coupled to a rotation shaft and in which the shielding member is raised and lowered upon rotation of the rotation shaft, the blind comprising:

a pulley;

a control member of which one end is connected to the pulley, the control member capable of being wound around and unwound from the pulley;

an urging member providing an urging force on the pulley in the direction of winding the control member;

a rotator which is disposed between the rotation shaft and the pulley and rotates together with the pulley when engaging the pulley;

a first clutch mechanism which is disposed between the rotation shaft and the rotator, the first clutch mechanism capable of linking the pulley and the rotation shaft with each other to transmit the rotation of the pulley to the rotation shaft, or the first clutch mechanism capable of interrupting the link between the pulley and the rotation shaft to interrupt the transmission of the rotation of the pulley to the rotation shaft; and a second clutch mechanism, the second clutch mechanism capable of linking the rotation shaft and a fixed member with each other, or the second clutch mechanism capable of interrupting the link between the rotation shaft and the fixed member, wherein:

action on the control member and rotation of the pulley engages the rotator and the first clutch mechanism to rotate the rotation shaft in one direction; another action on the control member and rotation of the pulley at a prescribed angle engages the second clutch mechanism to interrupt the link between the rotation shaft and the fixed member and enables the rotation shaft to rotate in the other direction.

12. The blind according to claim 11, wherein:

the rotator further comprises a plurality of engaging stubs arranged in a circumferential direction on the rotator; and wherein a second plurality of engaging stubs arranged in a circumferential direction on an end surface of the pulley engage with said engaging stubs of the rotator, and clearances are formed between the sets of engaging stubs.

13. The blind according to claim 11, wherein:

said pulley is supported to and turnable around a fixed shaft, and said fixed member includes a supporting shaft which is not turnable relative to the fixed shaft.

14. The blind according to claim 11, wherein:

after engagement of the first clutch mechanism and the rotation shaft has stopped rotating in one direction the second clutch mechanism is engaged to link the rotation shaft and the fixed member with each other to keep the rotation shaft stationary; and wherein, by action on the control member and turning of the pulley, the first clutch mechanism is engaged to stop the rotation shaft from rotating in the other direction.

15. The blind according to claim 11, wherein:

said control member includes a stopper greater in diameter than the control member that restricts the length of the control member wound up by the pulley.

16. The blind according to claim 11, wherein:

said first clutch mechanism comprises a switch-over guide capable of turning relative to the pulley within a prescribed range of rotational angles and an engaging member which turns together with the switch-over guide and is guided by the switch-over guide to move in the radial direction, the engaging member movable to a position where it transmits the rotation of the pulley to the rotation shaft or to a position where it does not transmit the rotation of the pulley to the rotation shaft depending on the rotational angle between the switch-over guide and the pulley, and wherein the switch-over guide is held by the fixed member with a force stronger than a rotational force received from the rotation shaft and weaker than an urging force received from said urging member.

17. The blind according to claim 11, wherein:

said first clutch mechanism comprises a switch-over guide capable of turning relative to the pulley within a prescribed range of rotational angles and an engaging member which turns together with the switch-over guide and is guided by the switch-over guide to move in the radial direction, the engaging member movable to a position where it transmits the rotation of the pulley to the rotation shaft or to a position where it does not transmit the rotation of the pulley to the rotation shaft depending on the rotational angle between the switch-over guide and the pulley, and wherein the switch-over guide cannot turn when the rotation shaft is rotating in the other direction and can turn together with the pulley when the pulley is turned by the urging member in the direction of winding up the control member.

18. The blind according to claim 11, wherein:

the rotation of said rotation shaft in the other direction is the direction in which the shielding member descends by its own weight.

19. The blind according to claim 11, further comprising:

a spring for urging said rotation shaft to turn in a direction corresponding to the ascending direction of the shielding member, wherein:

the rotation of said rotation shaft in the other direction corresponds to the direction in which the shielding member is urged by the spring to ascend.

20. The blind according to claim 11, wherein:

said rotation shaft is a rolling-up pipe to which one end of the shielding member is connected so as to permit the shielding member to be wound and unwound from the rolling-up pipe.

21. The blind according to claim 11, wherein:

said rotation shaft is either a drum to which one end of a lifting cord, of which the other end is connected to the bottom of the shielding member, is connected so as to permit the lifting cord to be wound around and unwound from the drum, or a member unturnably connected to a drum to which one end of a lifting cord, of which the other end is connected to the bottom of the shielding member, is connected so as to permit the lifting cord to be wound around and unwound from the drum.

* * * * *